US005184980A

United States Patent [19]

Ferris

[11] Patent Number: 5,184,980

[45] Date of Patent: Feb. 9, 1993

[54] SPORTS APPARATUS

[76] Inventor: Kevin S. Ferris, 111 Charles St., Townsville Queensland, Australia, 4814

[21] Appl. No.: 499,293

[22] PCT Filed: Sep. 22, 1988

[86] PCT No.: PCT/AU88/00373

§ 371 Date: May 16, 1990

§ 102(e) Date: May 16, 1990

[87] PCT Pub. No.: WO89/02771

PCT Pub. Date: Apr. 6, 1989

[30] Foreign Application Priority Data

Sep. 22, 1987 [AU] Australia ..... PI4498
Feb. 8, 1988 [AU] Australia ..... PI6647

[51] Int. Cl.[5] ..... A63C 19/10

[52] U.S. Cl. ..... 472/91; 472/90

[58] Field of Search ..... 272/3, 4, 56.5 R, 56.5 SS; 472/90, 91, 83, 92, 136

[56] References Cited

U.S. PATENT DOCUMENTS

| | | | |
|---|---|---|---|
| 318,025 | 5/1885 | Pusey | 272/56.5 SS |
| 318,026 | 5/1885 | Pusey | 272/56.5 SS |
| 3,815,901 | 6/1974 | Wiig | 272/56.5 SS |
| 4,148,477 | 4/1979 | Larson | 272/56.5 SS |
| 4,976,422 | 12/1990 | Shimamurh | 272/56.5 SS |

FOREIGN PATENT DOCUMENTS

| | | | |
|---|---|---|---|
| 191010 | 3/1961 | Sweden | 272/56.5 SS |

*Primary Examiner*—Richard E. Chilcot, Jr.
*Attorney, Agent, or Firm*—Edwin D. Schindler

[57] ABSTRACT

An artificial ski slope assembly is disclosed, which includes an upwardly moving inclined skiing zone formed as a zone on a moving endless conveyor assembly. The latter is suitably in the form of an inclined, distorted disc having one side part, which has a substantially horizontal portion at which snow may be added or refurbished, and an opposite side part which is inclined to form the skiing zone.

14 Claims, 9 Drawing Sheets

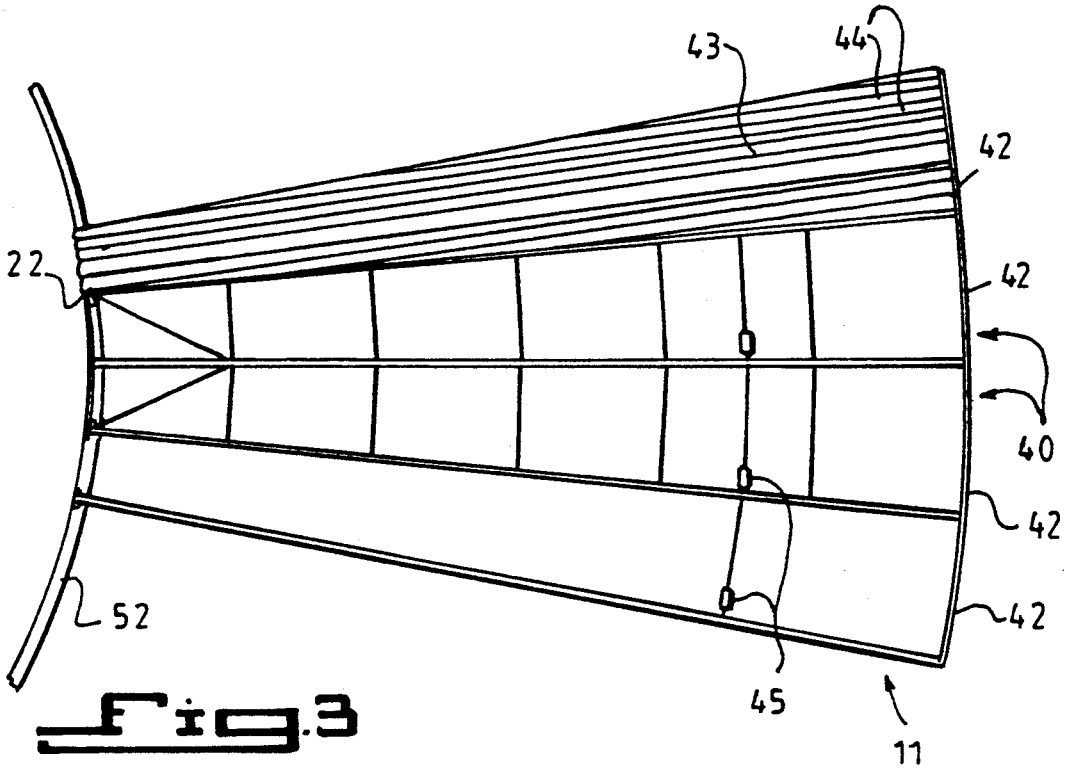
Fig.3
Fig.6
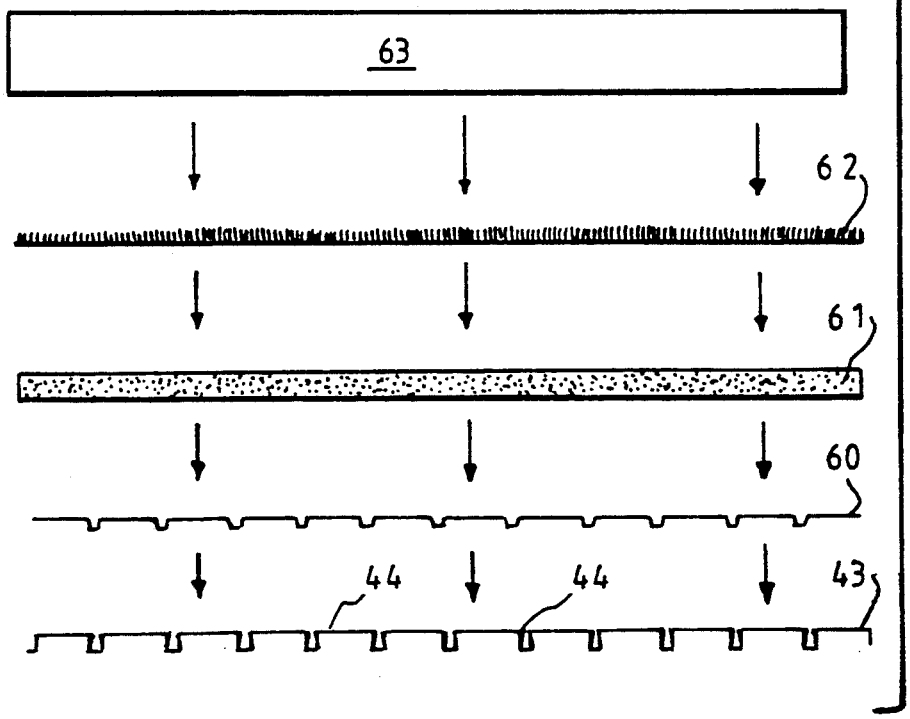

SPORTS APPARATUS

This invention relates to sports apparatus.

This invention has particular but not exclusive application to sports apparatus for the production of slopes for skiing, and for illustrative purposes reference will be made to such application. However, it is to be understood that this invention could be used in other applications, such as roller skating. Hereinafter the term skiing and analogous terms is to be taken as a general reference to snow or non-snow surface skiing as well as skating.

Skiing is a popular sport in most countries where snow-covered slopes are available. It is highly seasonal, and can only be practiced at certain times of year and in specific locations, generally locations which are remote from centres of population. On occasions when natural snow cover is inadequate, resorts are forced to generate artifical snow, and this process becomes quite expensive when long slopes must be treated.

The present invention aims to alleviate the above disadvantages and to provide sports apparatus which will be reliable and efficient in use. Other objects and advantages of this invention will hereinafter become apparent.

With the foregoing and other objects in view, this invention in one aspect resides broadly in sports apparatus including: a movable skiing assembly having an upper skiing surface including a skiing portion inclined to the horizontal: support means for movably supporting said skiing assembly, and drive means for moving said skiing assembly relative to said support means. The movable skiing assembly may be an inclined endless conveyor such as a belt conveyor covered with a synthetic skiing surface.

The skiing surface may be formed of a low-friction medium such as snow, whereby a skier may ski down said operational skiing zone against the movement of said skiing surface at a selected speed to provide the desired relative movement between the skier and the skiing surface.

Preferably, the supporting surface is in the form of a disc or annulus (hereinafter called a disc) rotatable about an inclined axis and supporting a skiing medium. The disc may be in the form of a flat ring formed of a flexible material or flexible structure. Of course, if desired, other forms of disc, such as a rigid disc mounted on or rotatable about an inclined shaft, may be used if desired. The disc may be formed from a plurality of rigid segments joined by flexible joints along adjacent edges such that circumferential flexibility is provided for the disc. The flexible joints may be in the form of flexural or rotational pivots, or may be in the form of linkages. The linkages may be formed such that adjacent rigid segments pivot at 0 selected height above their upper surfaces such that cracking of the snow layer at the flexible joint is minimised.

The support means may be in the form of rollers attached to the disc and running on rails mounted beneath the disc, and the disc drive means may take the form of friction drive from drive wheels mounted beneath the disc. Of course, other forms of support means, such as gas bearings or magnetic levitation, may be used if desired, and other forms of disc drive means, such as gears or direct-drive linear motors may also be used. For example, the disc may be supported directly on a contoured solid earth mound, and it may be elevated thereabove by the support means. Alternatively the skiing medium may be directly supported on the mound or other support and be driven to slide around the support. If desired, the support means may be height adjustable such that the shape of the disc may be altered.

Preferably, the upper surface of the disc is formed into a complex shape such that the operational portion is of substantially constant or skiable slope and constitutes as large a portion of the overall surface of the disc as is practicable whereby the portion of the disc which may be utilised for skiing may be maximised, and the remainder of the disc is formed into a return portion whereby the surface of the rotating disc may pass between the end and the start of the operational portion. Of course, if desired, other disc surface configurations, such as an inclined planar or frusto-conical surface, may be used. Preferably the disc has a mean or average inclination of between five and fifteen degrees.

The sports slope apparatus may be mounted outdoors, and natural snow cover may be utilised to form the skiing surface on the disc. However, it is preferred that refrigeration means be provided for preserving the snow cover on the disc and that the disc be at least partly enclosed within an enclosure such that heat influx from the environment to the disc is minimised. Snow apparatus for the application of artificial snow to the disc may be used to form the skiing surface on the disc. The snow apparatus and the refrigeration means may be enclosed within a refrigeration housing which also encloses a portion of the disc. It is preferred that the refrigeration housing enclose the portion of the disc remote from said skiing zone, and that the operational or skiing zone of the disc be external to the refrigeration housing such that skiers may not be subjected to the direct effects of refrigeration and snow making.

Of course, if desired, the skiing zone may be provided with shelter means, such as a sunshade or a housing, such that heat inputs to the snow from solar or other environmental effects may be minimised. Such shelter may be fixed or adjustable. It may, for example, be in the form of flexible covers which may be adjusted to shield selected portions of the apparatus. The upper surface of the disc may be formed from a flexible material such as fabric or metal-reinforced rubber. However, it is preferred that the upper surface of the disc include:

- a support layer of sheet material such as metal, formed with downward-facing grooves, such as "BONDECK";
- a seal layer of impervious plastics sheet material, such as "VISQUEEN" above the support layer;
- an intermediate layer of waterproof plastics foam insulating material, such as DOW CORNING "STYROFOAM" above the seal layer, approximately forty millimeters thick, and
- a layer of synthetic membrane material or synthetic grass material above the intermediate layer and upon which the snow layer 12 is formed.

If desired, a plurality of concentric discs may be provided, and selected discs may be rotated at differing speeds such that selected speed distributions may be achieved radially across their annular and or circular faces. For example, their may be provided an inner disc which rotates at a relatively slow speed, an intermediate annular surface which may be stationary or moving at a different rotational speed and an outer annular surface rotating at another speed. Alternatively, inner annular discs may rotate at slower speeds than the outer annular discs, whereby conditions suitable for a range of skiers may be provided. Alternatively, an inner discs may be rotated at faster rotational speeds than the outer annular discs, whereby a substantially constant tangential surface speed may be provided over the full radial extent of the annular discs.

In another aspect, this invention resides in snow skiing apparatus including a rotatable skiing surface passing through an operational skiing zone at which said skiing surface is inclined to the horizontal and a snow forming or reforming zone; snow forming means in said snow forming or reforming zone; support means supporting said skiing surface, and drive means for rotating said skiing surface through said skiing and snow forming or reforming zones.

In a further aspect this invention resides broadly in a method of forming a skiing slope whereby skiers may ski at a fixed location, the method including providing an inclined skiing zone having a skiing surface which may move along the skiing zone and moving the skiing surface upwardly across said skiing zone.

In order that this invention may be more easily understood and put into practical effect, reference will now be made to the accompanying drawings which illustrate a preferred embodiment of the invention, wherein:

FIG. 3 is a plan view of segments of the main disc;

FIG. 6 shows the arrangement of the sub-surface arrangement of the main disc;

Figure 1:
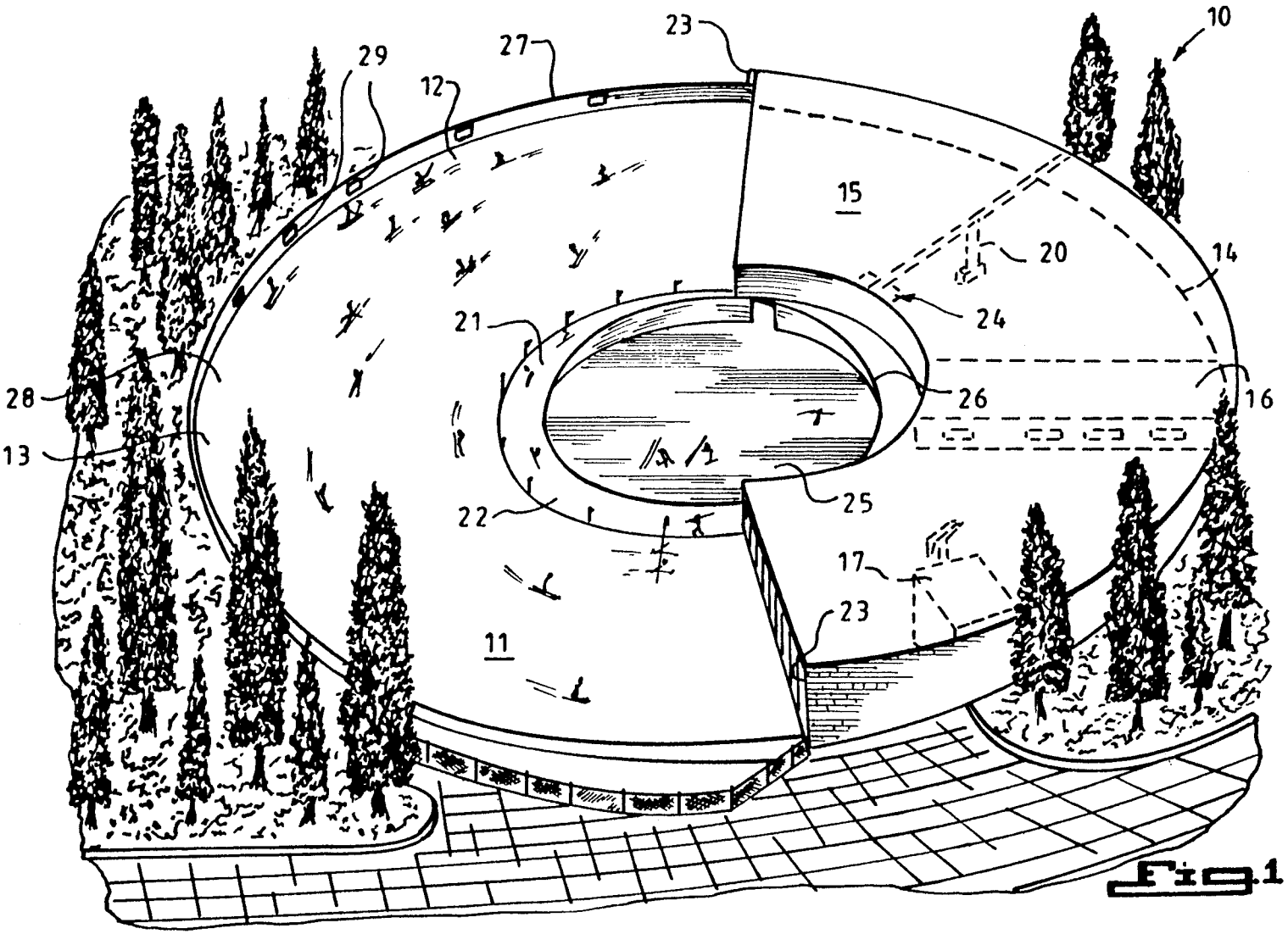
FIG. 1 is a pictorial view of a sports apparatus.
Figure 2:
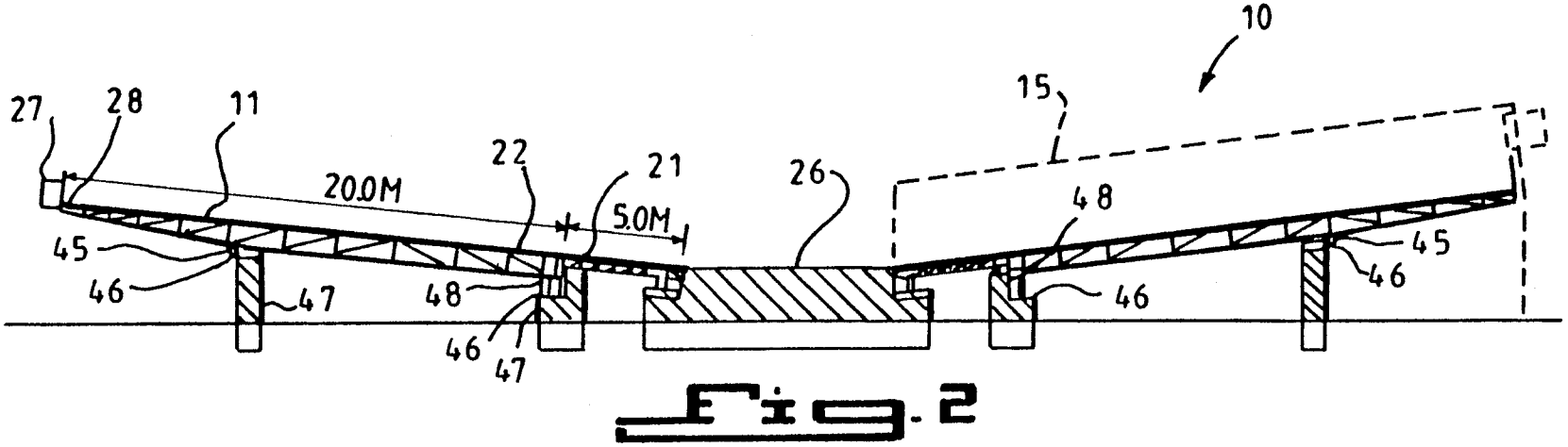
FIG. 2 is a cross section through the sports apparatus.

The sports apparatus 10 shown in FIGS. 1 and 2 has a main disc 11 covered with a layer of snow 12. The main disc 11 rotates clockwise at approximately 25 km/h, and has a skiing zone 13 and a return zone 14. The return zone 14 is enclosed in a cooling tunnel 15, within which refrigeration apparatus 16, snow-making apparatus 17 and snow grooming apparatus 20 are housed.

A static snow-covered ring 21 is directly adjacent to the inner edge 22 of the main disc 11, providing a starting area for skiers. As illustrated, the ice grooming means 20 includes a grooming roller 9 suspended on an arm 10, mounted on one run of an endless chain conveyor 8, which passes between guide pulleys in a known manner at opposite sides of the main conveying means 11. The ice grooming apparatus 20 can be moved across the main conveying means 11 by the conveyor 8 to groom the snow at any selected radial position of the main conveying means 11. Sensing equipment 23 at the ends of the cooling tunnel sense skiers entering the cooling tunnel 15, and control retraction apparatus 21 which retracts the snow grooming apparatus 20 upon sensing the entry of skiers into the cooling tunnel 15. Sensing equipment 23 may be any conventional sensor generally known and useful for detecting entry at a location. Such sensing equipment is commonly known as a "motion detector".

A stairway 25 through the hollow core 26 provides access to the main disc 11 for skiers. An air chamber 27 around the outer edge 28 of the skiing zone 13 distributes cold air over the surface of the skiing zone 13 through vents 29 to assist in maintaining a blanket of cold air above the snow 12.

Referring now to FIGS. 2, 3, 4, and 5, it will be seen that the main disc 11 is formed of a series of disc segments 40 which are linked to one another along their radial edges by segment pivots 41. Each of the disc segments 40 has a segment frame 42 with a top covering of ribbed sheet metal 43 with the ribs 44 placed downwards and aligned approximately radially.

Each disc segment 40 is supported on an inner wheel 48 and an outer wheel 45 which run on tracks 46 supported on the bases 47. The main disc 11 is driven by electric motors 50 and gear boxes 51 attached to selected outer wheels 45. Electric power is supplied to the electric motors 50 through slip rings 52 disposed around the inner edge 22 of the main disc 11.

As shown in FIG. 6, the ribbed sheet metal 43 covering the upper surface of each disc segment 40 supports an impervious layer of thin plastics sheet material 60 to keep water away from the ribbed sheet metal 43, and a sheet of waterproof plastics foam material 61 forty millimeters thick rests on the plastics sheet material 60.

The plastics foam material 61 supports a layer of artificial grass material 62 upon which a layer of snow 63 approximately two hundred millimeters thick is formed.

Figure 7:
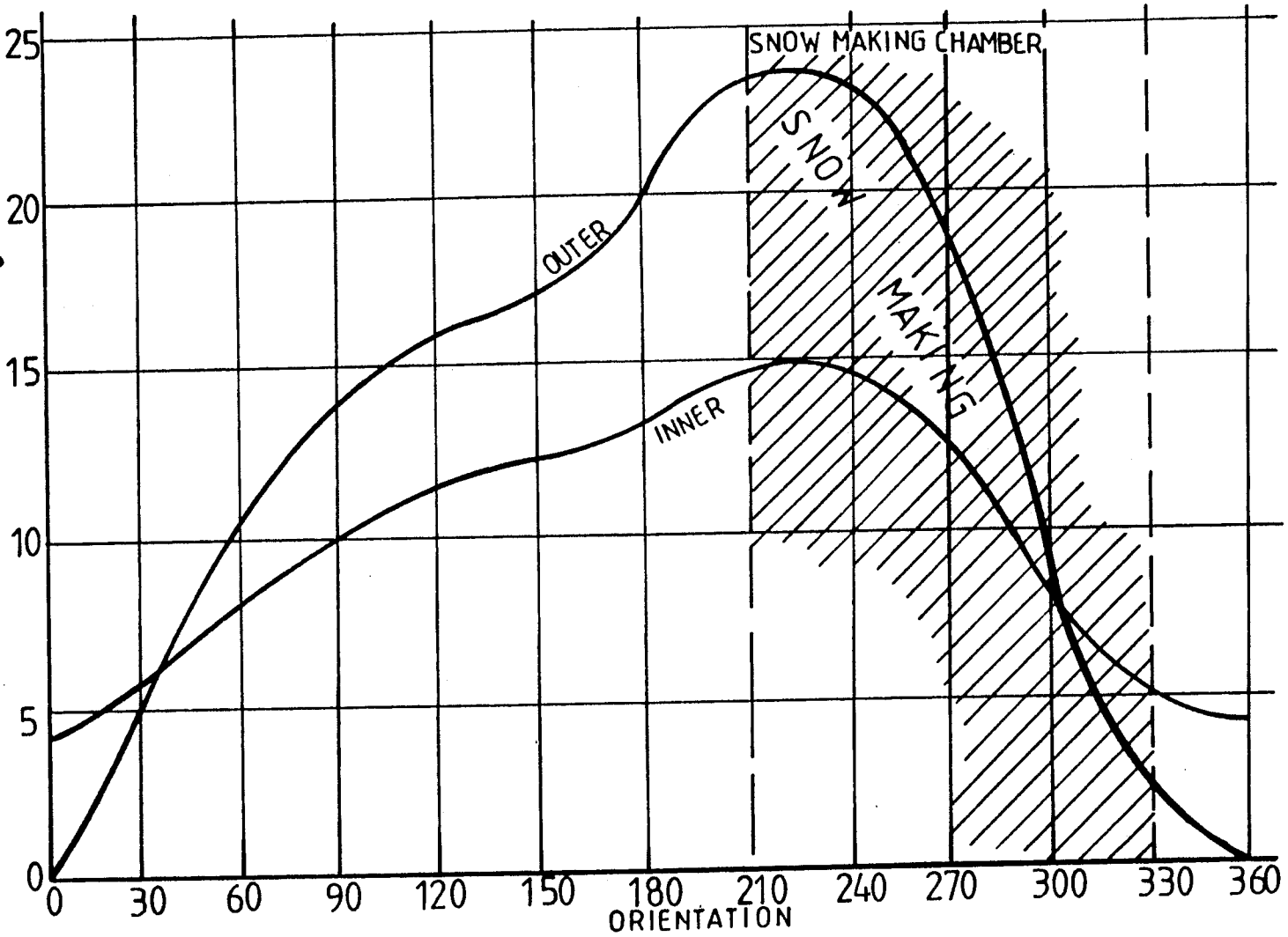
FIG. 7 is a graph of the relative elevation of the main disc around its perimeter.
Figure 8:
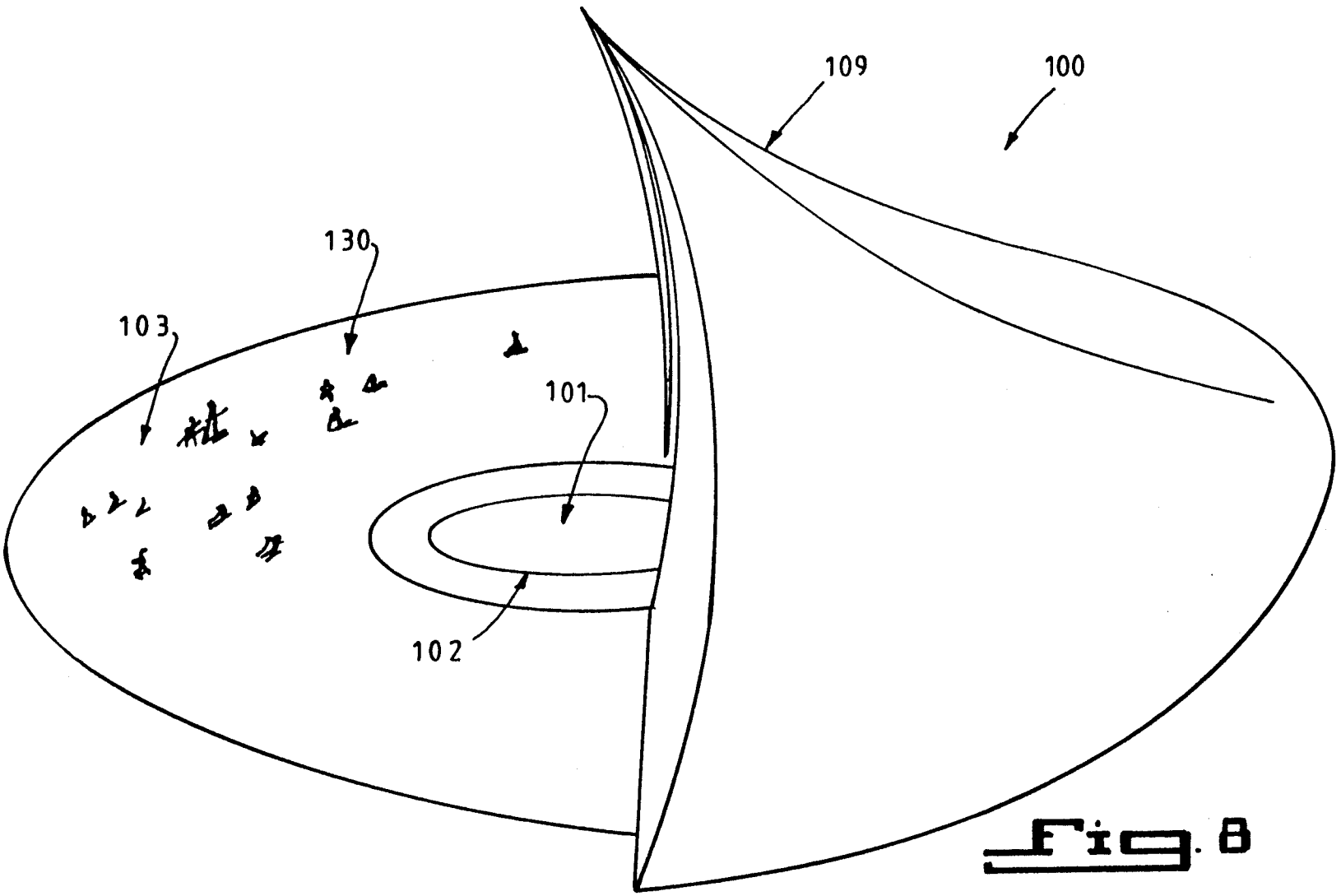
FIG. 8 is a diagrammatic view of a further embodiment of the invention.
Figure 9:
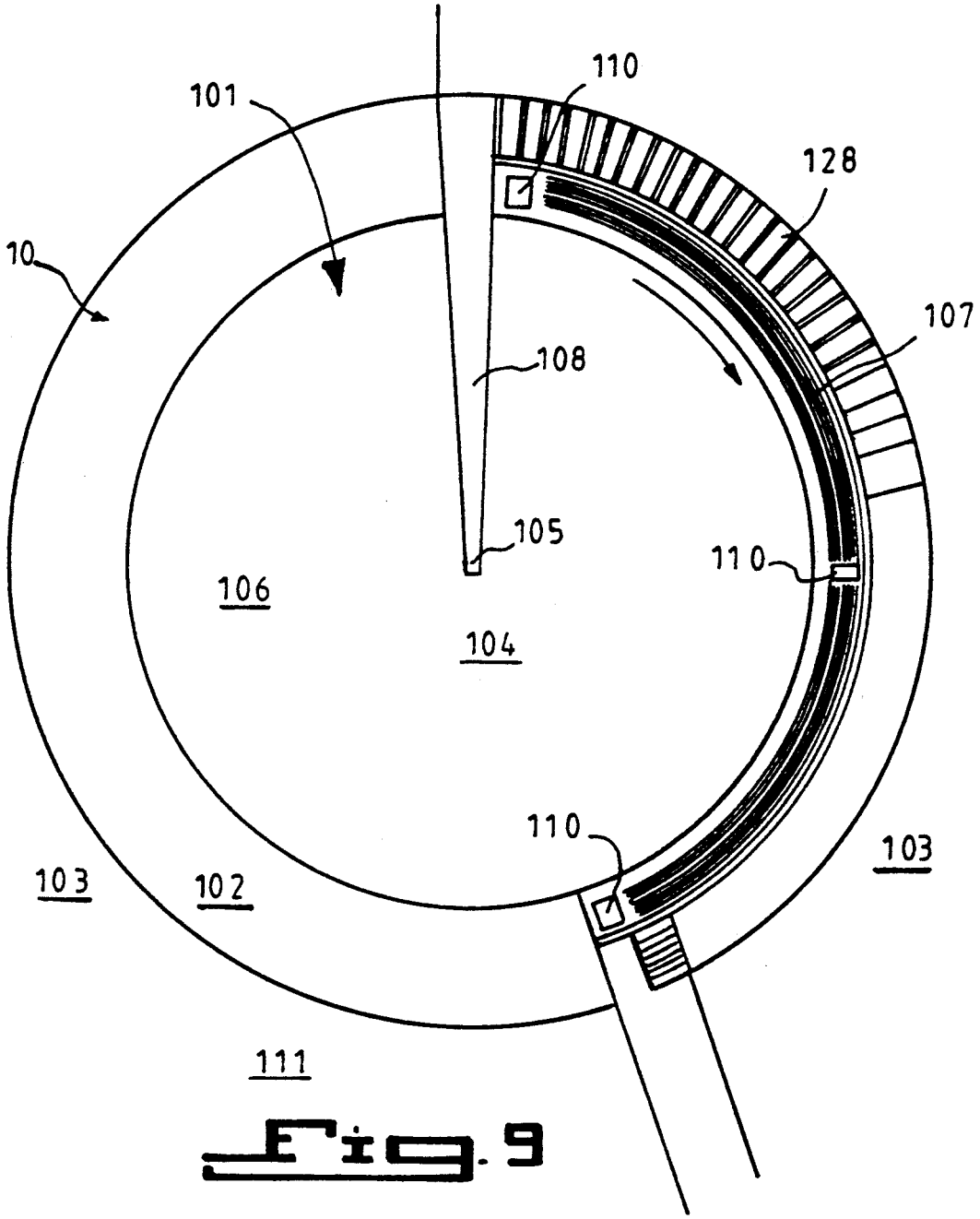
FIG. 9 illustrates the central portion of the FIG. 8 embodiment.

FIG. 7 shows graphically the changes in elevation of the inner edge 22 and the outer edge 28 of the main disc 11 as it passes through one rotation. It will be seen that the first sixty degrees of rotation clockwise from the lowest point take the main disc 11 from a state of reverse camber, with the outer edge 28 lower than the inner edge 22, to a state of positive camber, with the outer edge 28 higher than the inner edge 22.

The next one hundred degrees of clockwise rotation of the main disc 11 take it through the skiing zone 13, and within the latter, the tangential and radial inclinations of the main disc 11 are approximately constant. For the next fifty degrees of rotation, the outer edge 28 rises sharply, and the inner edge 22 rises somewhat less sharply before the main disc enters the cooling tunnel 15.

After rising slightly to its maximum elevation approximately two hundred and thirty degrees from its minimum elevation, the main disc falls rapidly in the cooling tunnel 15, the outer edge 28 falling more steeply than the inner edge 22 until the camber of the main disc 11 changes from positive to negative some sixty degrees before it reaches its minimum elevation.

In use, the main disc 11 is set in clockwise rotation by energising the electric motors 50, driving the outer wheels 45 along tracks 46. The snow-making apparatus 17 and the refrigeration apparatus 16 commence operation, building up a snow layer 12 on the main disc 11. When the snow layer 12 has built up to a satisfactory thickness, skiing may commence. The snow grooming apparatus 20 traverses the snow layer 12 radially, smoothing it out progressively.

Skiers enter the skiing zone 13 by climbing the stairs 25 through the hollow core 26, and move across the stationary inner ring 21 to join the skiing zone 13 at the inner edge 22. Skiers may ski at a suitable angle to the slope of the skiing zone 13, or control their downhill speed by ski movement, to make their downhill speed equal to the rotational speed of the main disc whereby they may maintain their position in the skiing zone 13. If a skier's speed falls, he will rise upward through the skiing zone, and if his speed increases, he will slide down through the skiing zone 13.

If a skier should enter the cooling tunnel 15, the sensing apparatus 23 detects the entry, and operates the retraction apparatus 24 to retract the snow grooming apparatus 20 such that no obstructions are presented to the skier as he passes through the cooling tunnel 15.

Water produced by the melting of the snow layer 12 percolates down to the synthetic grass 62, and drains radially from the main disc 11. Water which passes through the plastics foam layer 61 is caught in the grooves formed in the plastics sheet 60 by the ribs 44 in the ribbed sheet material 43, and also drains radially from the main disc 11.

The sport apparatus 100 illustrated in FIGS. 8 to 13, is similar to the earlier described apparatus. However, it provides a central beginners skiing area 101 and a stationary transfer zone 102 interposed between the beginners area 101 and the skiing surface 103.

In this embodiment the beginners skiing area 101 is in the form of a dished central disc 104 which is supported for rotation about an inclined axis 105 which in this embodiment is inclined at ten degrees to the vertical. This disc 104 is suitably of about thirty meters diameter and is rotated very slowly at about one revolution per hour so that beginners may ski down the small substantially stationary sloped skiing zone 106 of the disc 104 which is opposite the snow replenishment plant 107. Rotation of the disc 104 is provided so that the snow skiing surface thereon is replenished from a tapered delivery arm 108 which extends inwardly from the refrigeration plant 107 to the centre of the disc 104. Snow may be delivered to the taped delivery arm 108 by a continuous belt mechanism 128 from a suitable refrigeration plant which may produce ice which is converted into snow prior to delivery by the arm 108.

As illustrated, the snow replenishment plant 107 is covered by a membrane structure 109 supported by three pylons 110. The membraned structure extends part way across the central disc 104 leaving the skiing zone 106 is exposed. The membrane structure includes insulating curtains for keeping heat from the snow replenishment plant and moveable curtains which may be supported by lower annular tracks for movement from a stowed position, as illustrated, to a covering position at which the curtains may cover substantially the whole area of the skiing surface 111.

Figure 11:
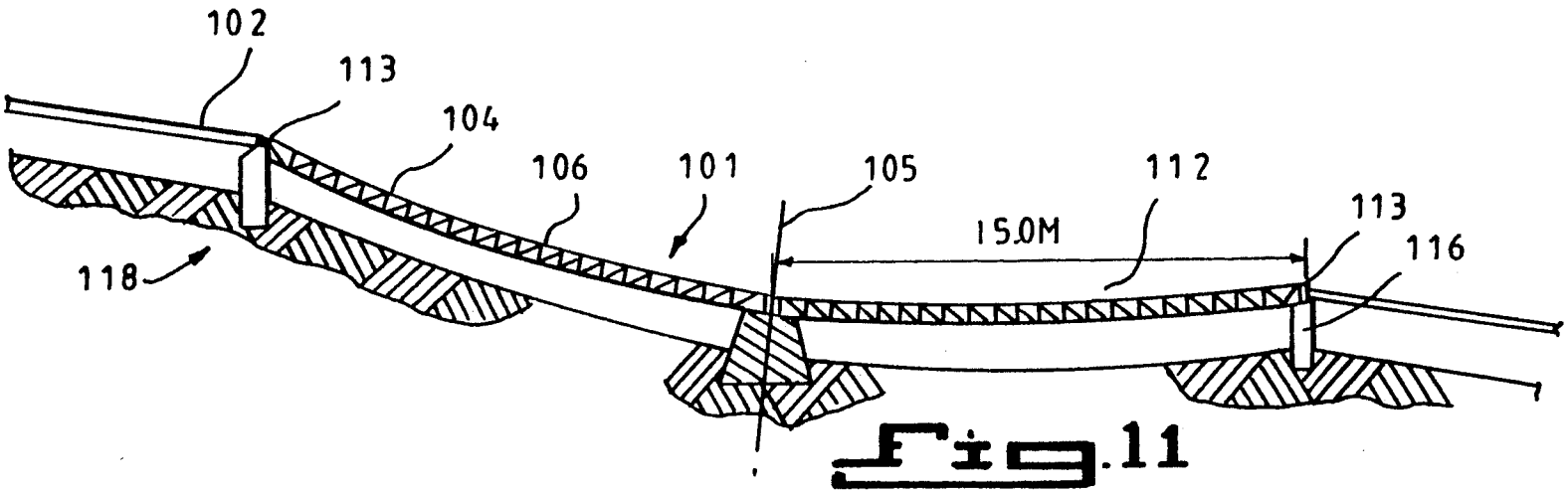
FIG. 11 is an enlarged cross-sectional view of the central portion corresponding to FIG. 10.
Figure 4:
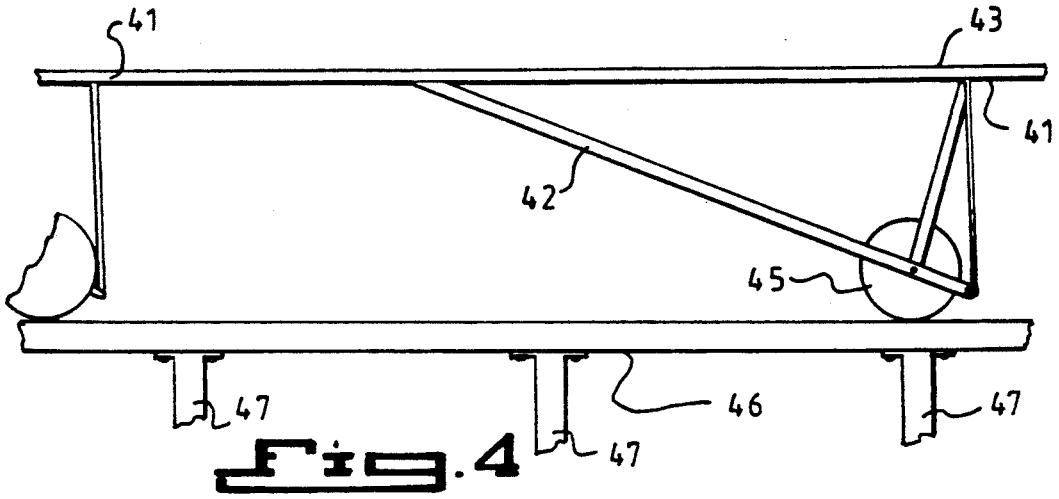
FIG. 4 is an end view of a disc segment.
Figure 5:
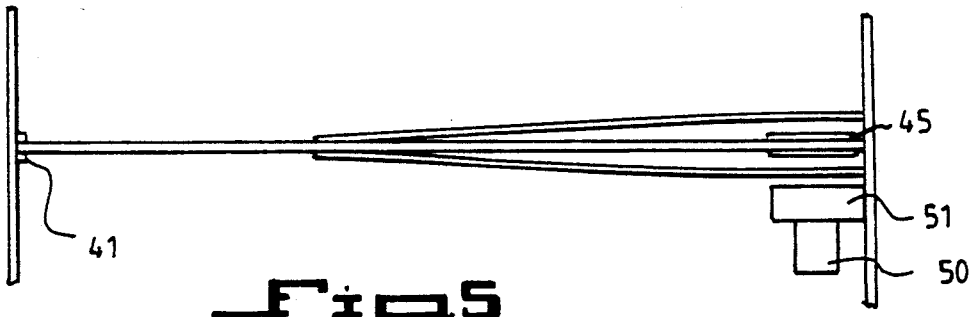
FIG. 5 is a partial top view of a disc segment.
Figure 13:
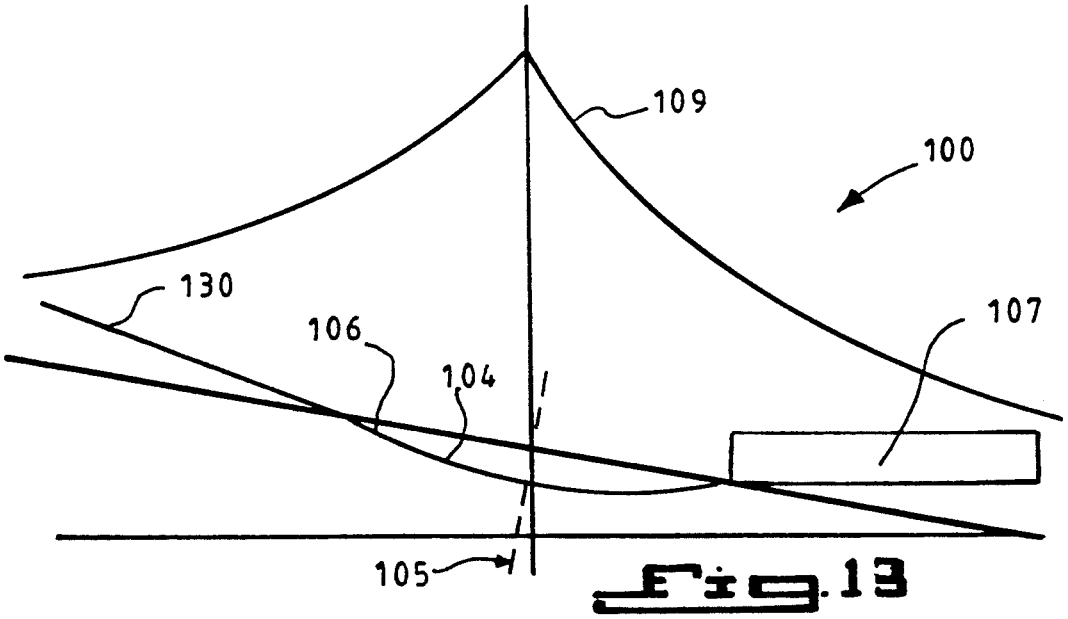
FIG. 13 is a diagrammatic view illustrating the inclination of the skiing surface.

As can be seen in FIG. 11, the dished central disk 104 is supported for rotation about an inclined axis and provides a skiing zone 106 which has a gentle beginners slope at one side of the disk 104 and a substantially horizontal portion 112 at the other side of the disk. This side 112, represents the covered portion at which snow replenishment is performed. The central disk 104 is formed as a framed truss structure which is supported peripherally by load bearing wheels 113 which engage the underside of the disk 104 and located by further wheels 114 supported on the disc 104 and engageable with side rail 115.

The rail 115 is mounted on the fixed structure 116 supported intermediate the central disk and the skiing surface 111. The fixed structure 116 forms the part annular transfer deck 103 which extends about the exposed portion of the central disk 104 and provides a users step-off point for transfer to either the beginners zone 106 or the skiing surface 111. The transfer deck is suitably covered with a synthetic grass or the like material, as illustrated.

Figure 10:
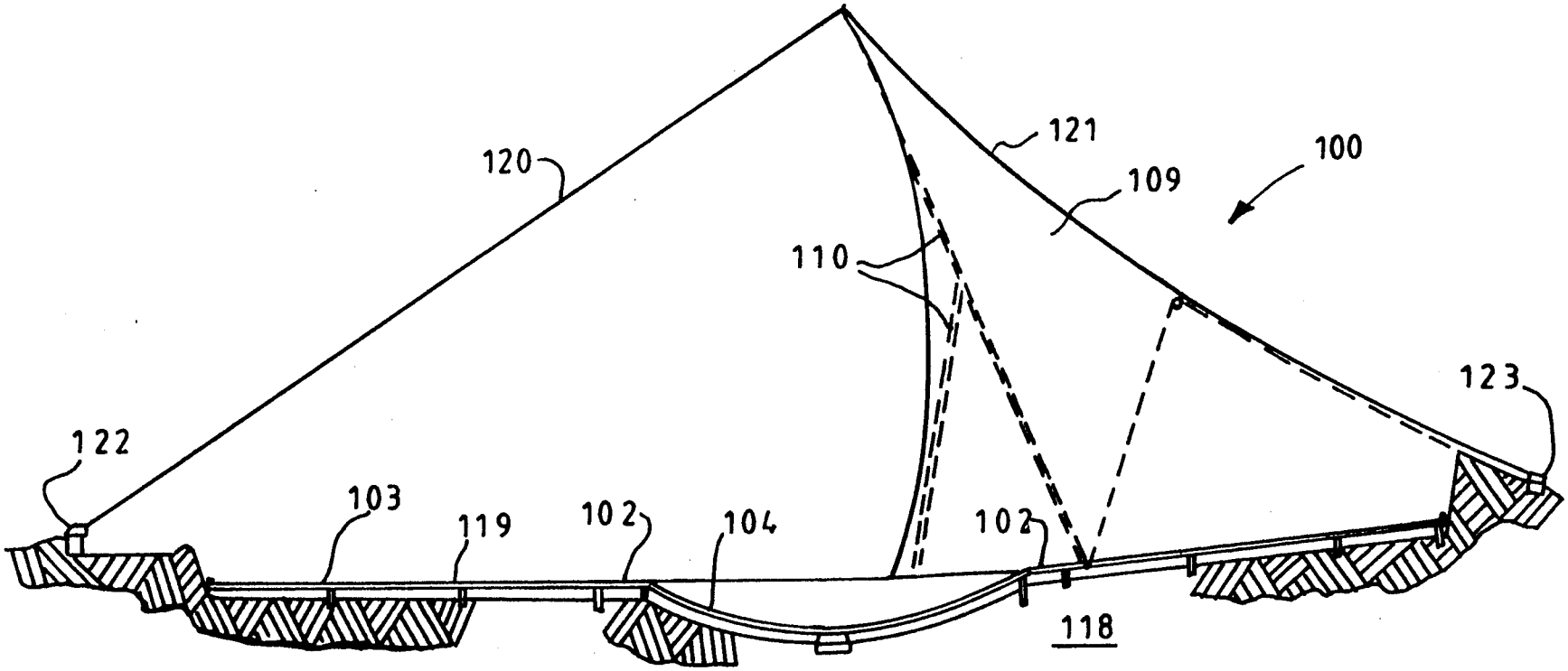
FIG. 10 is a cross-sectional view of the sports apparatus illustrated in FIG. 8.
Figure 12:
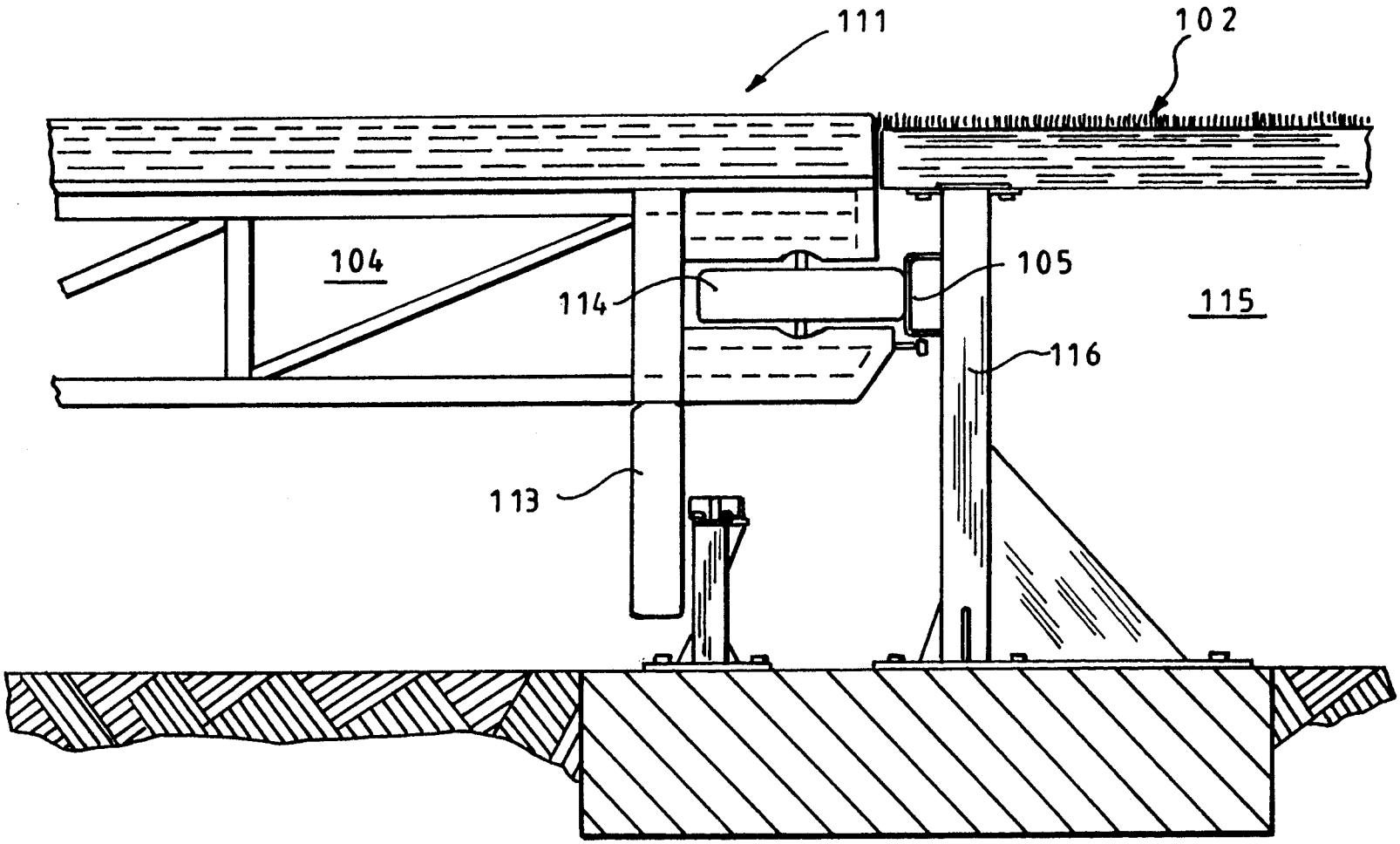
FIG. 12 is a further enlarged cross-section illustrating mechanical mounting details.

As shown in cross-section at FIG. 10, the sports apparatus 100 may be supported on a suitably contoured earth bed 118 provided with supports for rotatably supporting both the central disk 104 and the outer disk 119 which rotates about the transfer deck 102. The pylons 110, supporting the membrane structure 109, may provided cable anchors for cables 120 and 121 which extend therefrom to ground anchors 122 and 123 respectively. The cable 120 may provide a support for the covering in its extended position at which it covers substantially the full area of the skiing surface 103. Suitable detecting and control means may be employed to control the positions of the coverings to prevent unduly high wind loadings being applied thereto.

The central disk 104 and the outer disk 119 are suitably gear driven by electric motors whereby the speed of rotation may be selectively controlled. The outer disk may be rotated such that it rotates at a relatively slow average deck speed of three to five kilometers per hour which will provide a skiing zone 130 which is suitable for beginners. Alternatively, the outer disk may be driven such that it has an average deck speed of about ten kilometers per hour across the skiing zone 130 whereby the apparatus may be used to simulate skiing down a surface of approximately three hundred meters from top to bottom. At this speed a skier is able to experience the downward drop of a conventional slope. Preferably however, the outer disk is rotated at a speed in the order of twenty to twenty-five kilometers per hour such that skiers may be able to maintain equilibrium as they ski down the slope and thereby provide a non-stop ski of any selected duration.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

The claims defining this invention are as follows:

I claim:

1. An artificial ski slope assembly, comprising:

a skiing surface;

substantially annular form conveying means which is inclined and covered with said skiing surface and being rotatable so as to convey said skiing surface through a skiing zone disposed at an ascending side of said conveying means;

drive means for rotating said conveying means;

support means for rotatably supporting said conveying means with said supporting means supporting said conveying means so that said skiing surface is non-planar in said skiing zone whereby stationary horizontal ski positions relative to said skiing surface and within at least a lower portion of said ski zone are maintained substantially horizontal as those stationary ski positions are elevated through the lower portion of said ski zone by said conveying means.

2. The artificial ski slope assembly according to claim 1, wherein said skiing surface is a snow-covered surfaced and a descending side of said conveying means passes through a non-ski zone at which snow is deposited onto said conveying means.

3. The artificial ski slope assembly according to claim 1, wherein said conveying means is of annular conveying means form and is formed from pivotally interconnected wheel supported sectors arranged from travel around inner and outer endless supporting tracks contoured to conform said conveying means into said non-planar form in said skiing zone.

4. The artificial ski slope assembly according to claim 3, wherein said supporting tracks are arranged so that their respective slopes differ at common radial positions through said skiing zone.

5. The artificial ski slope assembly according to claim 3, wherein each wheel-supported sector includes a supporting base, an intermediate insulating medium and an upper layer of snow.

6. The artifical ski slope assembly according to claim 1, wherein said conveying means is of part-conical form and is formed from pivotally interconnected wheel supported sectors arranged from travel around inner and outer endless supporting tracks contoured to conform said conveying means into said non-planar form in said skiing zone.

7. The artificial ski slope assembly according to claim 6, wherein said supporting tracks are arranged so that their respective slopes differ at common radial positions through said skiing zone.

8. The artificial ski slope assembly according to claim 6, wherein each wheel-supported sector includes a supoorting base, an intermediate insulating medium and an upper layer of snow.

9. The artificial ski slope assembly according to claim 1, wherein said skiing surface includes artificially-produced snow.

10. The artificial ski slope assembly according to claim 1, wherein said annular form conveying means extends about an inner skier supporting deck.

11. The artifical ski slope assembly according to claim 10, wherein said skier supporting deck is a stationary deck.

12. The artificial ski slope assembly according to claim 10, wherein said skier supporting deck is a disc-like support structure located at the center of said skiing surface and independently rotatable relative to said conveying means.

13. The artificial ski slope assembly according to claim 12, wherein said disc-like support structure is rotatable about an inclined axis at a relatively slow speed for providing a beginner's slope.

14. The artificial ski slope assembly according to claim 12, wherein said disc-like support structure is concave-shaped.

* * * * *